US010401037B2

(12) United States Patent
Biocco et al.

(10) Patent No.: US 10,401,037 B2
(45) Date of Patent: Sep. 3, 2019

(54) VERTICAL EXTRACTOR HOOD FOR A KITCHEN

(71) Applicant: FABER S.p.A., Fabriano (Ancona) (IT)

(72) Inventors: Simone Biocco, Fabriano (IT); Simone Celli, Pescara (IT); Francesco Faginoli, Fabriano (IT); Fabio Romani, Fabriano (IT)

(73) Assignee: FABER S.p.A., Fabriano (Acona) (IT)

( * ) Notice: Subject to any disclaimer, the term of this patent is extended or adjusted under 35 U.S.C. 154(b) by 0 days.

(21) Appl. No.: 15/462,033

(22) Filed: Mar. 17, 2017

(65) Prior Publication Data

US 2017/0292716 A1 Oct. 12, 2017

(30) Foreign Application Priority Data

Apr. 7, 2016 (IT) ..... 202016000035720

(51) Int. Cl.
*F24C 15/20* (2006.01)

(52) U.S. Cl.
CPC ..... *F24C 15/2042* (2013.01); *F24C 15/20* (2013.01); *F24C 15/2092* (2013.01)

(58) Field of Classification Search
CPC .. F24C 15/20; F24C 15/2042; F24C 15/2092; F27D 17/001; F23J 11/00
USPC ..... 126/80, 299, 299 R
See application file for complete search history.

(56) References Cited

FOREIGN PATENT DOCUMENTS

| | | | | | |
|---|---|---|---|---|---|
| CN | 101846351 | | | 9/2010 | |
| CN | 101846351 | A | * | 9/2010 | |
| CN | 201662121 | | | 12/2010 | |
| CN | 201858696 | | | 6/2011 | |
| CN | 202813526 | U | * | 3/2013 | |
| CN | 103343997 | | | 10/2013 | |
| CN | 103673001 | A | * | 3/2014 | |
| DE | 102009002773 | | | 11/2010 | |
| DE | 102010063860 | | | 6/2012 | |
| DE | 102010063860 | A1 | * | 6/2012 | ..... F24C 15/20 |
| FR | 2385998 | A1 | * | 10/1978 | ..... F24C 15/2035 |
| FR | 2454341 | A1 | * | 11/1980 | ..... F24C 15/2092 |

* cited by examiner

*Primary Examiner* — Gregory L Huson
*Assistant Examiner* — Brandon Nelan
(74) *Attorney, Agent, or Firm* — Volpe and Koenig, P.C.

(57) ABSTRACT

An extractor hood (1) with a body (2) which is hollow in its interior (at 15), provided with a lateral opening (8) and containing in its cavity (15) a fan (16) which can aspirate from the lateral opening (8) fumes and/or vapors generated by an underlying hob of a kitchen, the body (2) having opposite surfaces (5, 6) with a larger area, connected by walls or surfaces (10, 11, 12, 13) with a smaller area, a first one (5) of the surfaces (5, 6) with the larger area being placed on a vertical wall (2) of said kitchen, the second surface (6) with the larger area containing the aforementioned lateral opening (8), and in front of this opening (8) there being a flat panel (23) placed spaced from this second larger surface. This flat panel (23) is parallel to the second surface (6), including when the hood (1) is in use.

6 Claims, 2 Drawing Sheets

VERTICAL EXTRACTOR HOOD FOR A KITCHEN

INCORPORATION BY REFERENCE

The following documents are incorporated herein by reference as if fully set forth: Italian Utility Model Application No. 202016000035720, filed Apr. 7, 2016.

BACKGROUND

The subject of the invention is an extractor hood for a kitchen.

As is known, various types of extractor hoods for kitchens exist. The invention relates to hoods which are placed on a vertical wall of the kitchen (secured directly on it, or on an intermediate support unit, which does or does not form part of the kitchen furnishings), or placed above a hob where fumes and/or vapors to be aspirated are generated.

Hoods of the aforementioned type, which will be indicated in the present text as "vertical extractor hoods", usually comprise a body containing a fan and having an aspiration opening or inlet for the fumes and/or vapors aspirated and an outlet or discharge opening for whatever is aspirated. The outlet opening can be connected to a duct which transfers these fumes and/or vapors outside the environment where they have been generated or this outlet opening can be provided with appropriate known filtering means, and also opens into said environment, transferring whatever has been aspirated into the latter after filtering.

The aspiration opening can be provided at a portion of the hood arranged above the hob of the kitchen, and parallel to this surface. Or, this opening is placed at a lateral surface of the hood where there is a movable panel which can be arranged inclined relative to this opening so as to make it possible to draw into it fumes and/or vapors aspirated. Other extractor hoods have portions which are formed in various ways associated with this inlet opening for the fumes and/or vapors, or which hoods themselves contain this opening.

With particular reference to the vertical hoods with an aspiration opening in a lateral surface, these hoods comprise a body which usually has a first and a second surface with a large size: a first surface is placed on the kitchen wall (for example it is secured to the wall), whereas the second surface contains said aspiration opening.

These surfaces are connected to other, smaller lateral walls or surfaces of the body of the hood. Inside this body there is a fan which aspirates the fumes and/or vapors from the aspiration opening and sends them to the discharge opening.

Usually, the second surface is placed inclined relative to the first in order to assist the aspiration by the fan. In addition, the aspiration opening of said second surface is usually covered by one or more movable panels which can assist the aspiration action of the fan.

These vertical hoods with the aspiration opening in a lateral surface are aesthetically very attractive.

SUMMARY

The present invention relates to a vertical hood with a lateral aspiration opening which aims to improve the aesthetics further.

In particular, an objective of the present invention is to provide a vertical hood of the aforementioned type, the overhang of which from the wall to which it is close or to which it is secured is not modified, so as to be a furnishing element of the kitchen itself.

Another objective of the invention is to provide a hood which however has a minimum overhang from the kitchen wall.

A further objective of the invention is to provide a hood of the aforementioned type which however has performance levels which are at least comparable to those of the known vertical hoods, which is reliable to use in the long term, and has production costs which are similar to those of the aforementioned known vertical hoods.

These objectives and others, which will be apparent to persons skilled in the art, are achieved by a vertical hood of the type referred to and in accordance with the combined claims.

BRIEF DESCRIPTION OF THE DRAWINGS

For better understanding of the present invention, and purely by way of non-limiting indication, the following drawings are appended, in which.

DETAILED DESCRIPTION OF THE PREFERRED EMBODIMENTS

Figure 1:
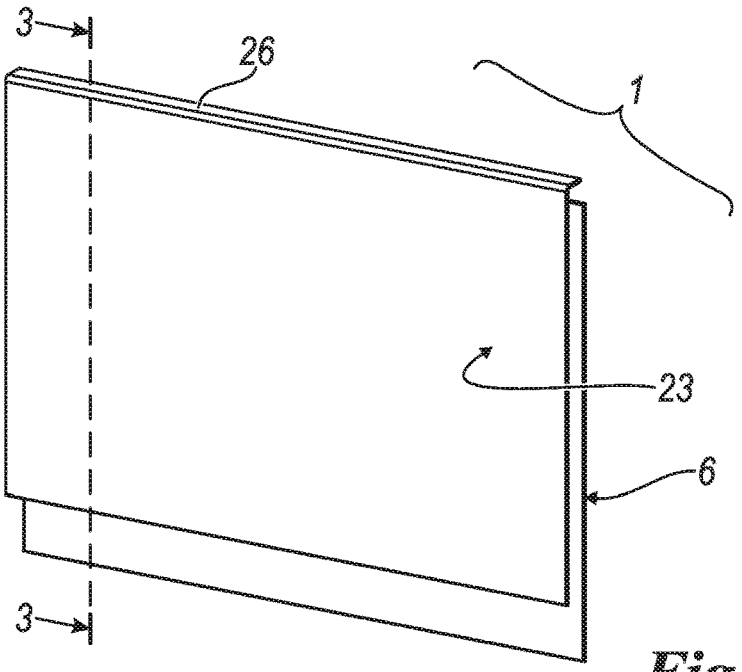
FIG. 1 shows a view in perspective of a vertical hood according to the invention.
Figure 2:
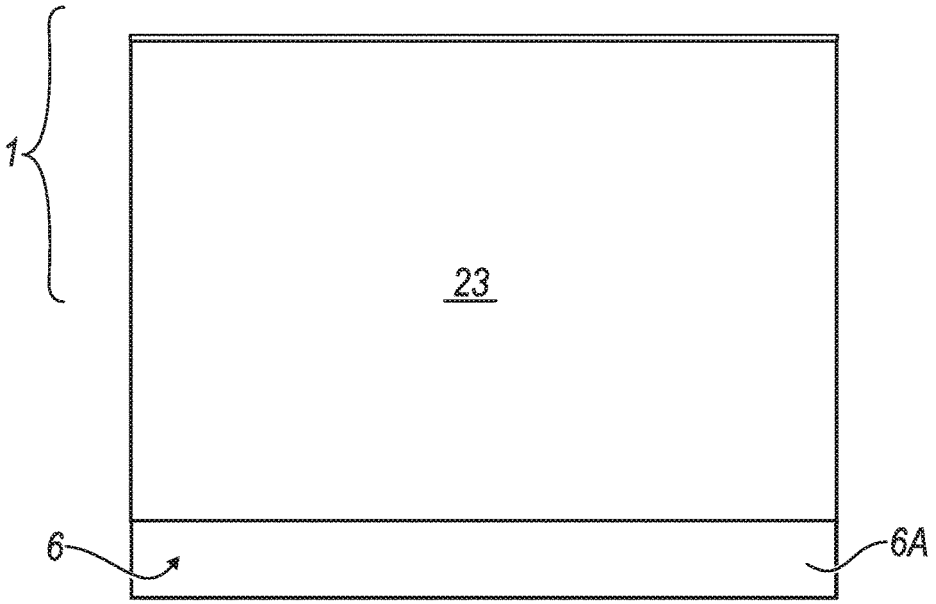
FIG. 2 shows a front view of the hood in FIG. 1.
Figure 3:
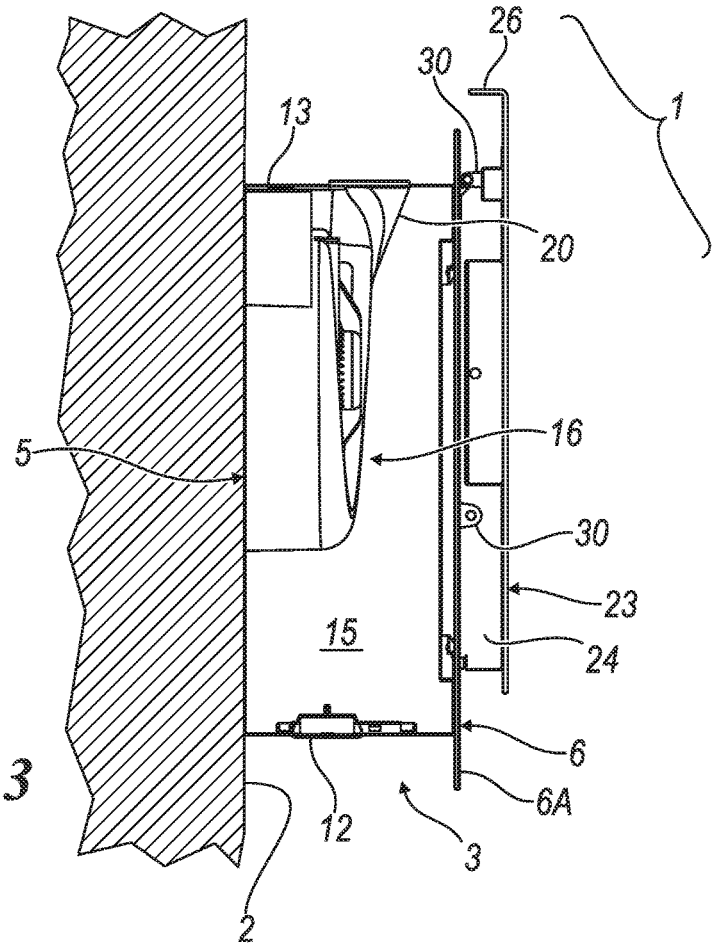
FIG. 3 shows a view in cross-section according to the line 3-3 in FIG. 1.
Figure 4:
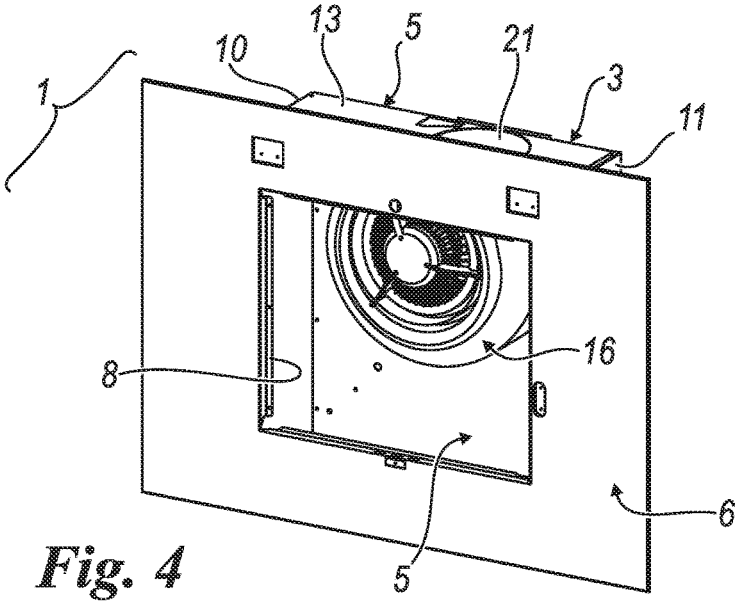
FIG. 4 shows a view in perspective of the hood in FIG. 1 with a part removed in order to show a particular portion of the hood.

With reference to said figures, a hood according to the invention is generally indicated as 1. This hood is a vertical hood which in the example is secured on a vertical wall 2 of a kitchen, and is placed above a hob (not shown) close to this wall.

The hood 1 has a body 3 with a first and a second flat surface 5 and 6 with a larger size or area, placed at a short distance from one another. These surfaces 5 and 6 are substantially parallel, although there can be a limited inclination of the second surface 6 towards the first in its lower part 6A which is closest to the underlying hob.

The second surface 6 has an aspiration opening 8.

These surfaces 5 and 6 are interconnected, and spaced by flat lateral walls or surfaces 10, 11, 12 and 13 with a smaller size. These surfaces together define the body 3, which is therefore hollow in its interior at 15.

The cavity 15 contains a fan 16, which is secured on the first flat surface 5 with a larger size or area and/or on the surface 13 with a smaller size (or upper wall of the hood). The fan is placed at the front of the aspiration opening 8, or is misaligned at the most only slightly relative to this opening. The fan has a delivery or discharge duct 20 connected to a discharge opening 21 of the hood 1, which in the example opens into the upper wall 13 of the hood 1.

The discharge opening 21 can be connected to a duct (not shown) for discharge, to the exterior of the kitchen, of the fumes and/or vapors aspirated, or correspondingly, in a known manner (and not shown), conventional filters can be provided for reintroduction of whatever is aspirated from the hob (suitably filtered) back into the kitchen itself.

At the front of the second flat surface 6 with a larger size or area and in front of the aspiration opening 8 provided in the latter, there is a flat panel 23 placed at a short distance (for example 4-8 cm) from said surface 6. Between the panel 23 and this surface, a narrow space 24 is thus created, which assists the aspiration of the fumes and/or vapors by the fan 16 through the opening 8.

Preferably, this space 24 is closed on one side by an end portion 26 of the panel 23 folded back towards the second surface 6.

The panel 23 is secured by means of conventional fastening elements on the second flat surface 6 with a larger size or area. For example, screws, nuts and bolts or the like can be provided, which secure tabs 30 of the panel 23 on said surface 6, and keep said panel parallel to the flat surface 6 with a larger size, including when the hood is in use.

Moreover, it is possible for this panel 23 to be movable relative to the second surface 6, and spaced from the underlying hob in order to clear a portion of the aspiration opening 8 so as to increase the aspiration action of the fan 16, again by means of said fastening elements. For example, this movement of the panel 23 can take place parallel to itself, continuously or discretely.

By means of the invention, the extractor hood has a form which is aesthetically very attractive. Advantageously, the distance between the panel 23 and the wall 2 can be between 20 and 25 cm, thus providing the hood with a very compact form which is almost comparable to that of an LCD screen or the like. Indeed, this gives the hood a very "neat" form, and allows it to be used virtually as a furnishing element of the kitchen.

Despite its extreme compactness, the hood 1 nevertheless has excellent aspiration capacities (like those of the known hoods) because of the presence of the panel 23 at a short distance from the second surface 6 with a larger size of the body 2 of the hood 1. This distance makes it possible to create an area of low pressure in the hood, which draws the fumes and/or vapors from the hob, thus making these fumes/vapors move at high speed (therefore assisting in removing them from this surface). A sheet of fumes and/or vapors is substantially generated, which is aspirated rapidly through the large opening 8, the size of which is advantageously equal to 40% of the entire area of the aforementioned second surface 6.

Thanks to its form, the hood 1 can easily be positioned close to a wall in the vicinity of the hob.

A description has been provided of one embodiment of the invention. It will be appreciated that others are also possible for persons skilled in the art on the basis of what has been described: for example, the panel 23 can be provided on its wall which faces the opening 8 with parts (for example finning, pairs of adjacent fins inclined in opposite directions) which are formed such as to stimulate the fumes and/or vapors aspirated to move towards this opening, or a filtering means can be provided at the access to the space 24. Variants of this type can also be considered to be included in the scope of the invention, as indicated in the following claims.

The invention claimed is:

1. An extractor hood (1) comprising a body (2) which is hollow in an interior thereof to define a cavity, provided with a lateral opening (8) and containing a fan (16) in the cavity (15) which aspirate from the lateral opening (8) at least one of fumes or vapors generated by an underlying hob of a kitchen, said body (2) having opposite surfaces (5, 6) with a larger area, connected by surfaces (10, 11, 12, 13) with a smaller area, a first one (5) of said opposite surfaces (5, 6) with the larger area being adapted to be placed on a vertical wall (2) of said kitchen, a second of the larger surfaces (6) with the larger area contains the lateral opening (8), and in front of said opening (8) there being a flat panel (23) spaced apart from and at least partially overlapping said second larger surface, and said flat panel (23) is parallel to said second surface (6), including when the hood (1) is in use; an opening space (24) being located between said flat panel (23) and said second larger surface (6), in a use position said opening space (24) is open in a direction defined parallel to the flat panel (23) that is adapted to be directed towards the underlying hob, into which the at least one of fumes or vapors are drawn by the fan (16) and are directed towards the lateral opening (8) in the body (2) of the hood (1), said opening space (24) is closed on one side by a folded-back part (26) of the flat panel (23) facing towards the second larger surface (6), and a distance of the flat panel (23) from the second larger surface (6) is between 4 and 8 cm such that the opening space (24) defines a narrow space that is smaller in comparison to a size of the lateral opening (8), the opening space (24) being adapted to create an area of low pressure to assist in aspiration of the at least one of fumes or vapors into said space (24).

2. The extractor hood according to claim 1, wherein a distance between the flat panel (23) and a wall of the kitchen is adapted to be between 20 and 25 cm.

3. The extractor hood according to claim 1, wherein said flat panel (23) is integral with the second larger surface (6) of the body (2) of the hood (1).

4. The extractor hood according to claim 1, wherein the flat panel is movable relative to said second larger surface (6).

5. The extractor hood according to claim 4, wherein the flat panel is movable discretely or continuously, parallel to the second larger surface.

6. The extractor hood according to claim 1, wherein said flat panel has elements which are adapted to direct the at least one of fumes or vapors aspirated from the hob towards the lateral opening (8) in the body (2) of the hood (1).

* * * * *